US005681197A

United States Patent [19]

Egami et al.

[11] Patent Number: 5,681,197

[45] Date of Patent: Oct. 28, 1997

[54] METHOD OF FIXING TO FRAME ELECTRODE OR SHADOW MASK FOR COLOR IMAGE RECEIVING TUBE

[75] Inventors: Norihiko Egami, Hirakata; Hideo Suzuki, Neyagawa; Manabu Kakino, Uji; Masaru Nagaike, Hirakata; Takashi Ichiyanagi, Hirakata, all of Japan

[73] Assignee: Matsushita Electric Industrial Co., Ltd., Osaka-fu, Japan

[21] Appl. No.: 513,115

[22] Filed: Aug. 9, 1995

[30] Foreign Application Priority Data

Aug. 11, 1994 [JP] Japan ..... 6-189407

[51] Int. Cl.[6] ..... H01J 9/18

[52] U.S. Cl. ..... 445/30; 445/37; 29/448

[58] Field of Search ..... 445/30, 37; 29/448

[56] References Cited

U.S. PATENT DOCUMENTS 5,041,756 8/1991 Fairbanks ..... 445/30 X 5,348,506 9/1994 Kawamura et al. ..... 445/30

*Primary Examiner*—Kenneth J. Ramsey

*Attorney, Agent, or Firm*—Wenderoth, Lind & Ponack

[57] ABSTRACT

A method for fixing to a frame an electrode or a shadow mask for an image receiving tube. The method includes steps for stretching, in opposite directions, supporting ends of a rectangular mask plate having apertures formed between the supporting ends, in order to generate a tensile force having a uniform distribution over the entire surface of the plate. The method also includes pressing inwardly and bending a pair of elastic supporting elements, constituting two confronting sides of a frame, so that a distribution of the pressing force in a direction of each of the sides almost balances with a distribution of the tensile force. The supporting ends of the mask plate are then rigidly fixed to both of the bent supporting elements of the frame. The stretching and pressing forces applied to the mask plate and the frame are then released.

7 Claims, 9 Drawing Sheets

METHOD OF FIXING TO FRAME ELECTRODE OR SHADOW MASK FOR COLOR IMAGE RECEIVING TUBE

BACKGROUND OF THE INVENTION

The present invention relates to a method for fixing to a frame, a thin plate such as an electrode or a shadow mask for an image receiving tube, for example, fixing to frames color-selecting electrodes or shadow masks for color image receiving tubes used in TV receivers or terminal displays of computers, etc.

In general, there are two types of color-selecting electrodes for color image receiving tubes, i.e., shadow mask type and grille type. FIG. 20 indicates a color-selecting electrode of the mask type, which is composed of a rectangular metallic mask plate 1 and a rectangular metallic frame 2. Many wire-shaped or strip parts 5 are arranged at predetermined intervals between supporting ends 3 and 4 at two opposite sides of the mask plate 1. A slot-shaped aperture 6 is formed between the adjacent strip parts 5 to pass electron beams.

The frame 2, supporting the mask plate 1 in tensity, is constituted of a pair of U-shaped elements 7 and 8 which are parallel to each other and a pair of elastic supporting elements 9 and 10 bridging end parts of the elements 7 and 8. Each supporting element 9, 10 has an L-shaped cross section. The supporting ends 3 and 4 of the mask plate 1 are rigidly fixed to projecting ends 9*a* and 10*a* of the supporting elements 9 and 10.

In securing the supporting ends 3 and 4 to the projecting ends 9*a* and 10*a*, first, each projecting end 9*a*, 10*a* of the supporting element 9, 10 of the frame 2 is pressed and bent inward as shown in FIG. 21A. While in the above state, the projecting ends 9*a*, 10*a* are face-bonded to the supporting end 3, 4 of the mask plate 1 as shown in FIG. 21B. Thereafter, in FIG. 21C, the end 9*a*, 10*a* is freed from the pressing operation, whereby a spring force of the projecting ends 9*a*, 10*a* acts on the mask plate 1 and then the mask plate 1 is stretched.

A tensile force necessary for the mask plate to maintain a predetermined flatness is as large as approximately 10 $Kgf/mm^2$. Although it is required to apply such a spring force to the frame that produces a tensile force of the above size, the frame shows a low rigidity at a center of each elastic supporting element at either side and therefore, the center of each elastic supporting element after the frame is released from the pressing operation is liable to be short of a sufficient repulsive force.

SUMMARY OF THE INVENTION

The object of the present invention is therefore to provide a method of fixing an electrode or a shadow mask wherein a mask plate is stably stretched on the frame with higher flatness.

In accomplishing these and other objects, according to a first aspect of the present invention, there is provided a method of fixing to a frame an electrode or a shadow mask for an image receiving tube, which comprises steps of:

stretching, in opposite two directions, both supported ends of a rectangular mask plate having apertures formed between the supporting ends at opposite sides, thereby to generate a tensile force of a uniform distribution all over a surface of the plate;

pressing inwardly and bending a pair of elastic supporting elements constituting two confronting sides of a frame so that a distribution of a pressing force in a direction of each of the sides almost balances with a distribution of the tensile force;

rigidly fixing both supporting ends of the mask plate subject to the tensile force to the bent supporting elements of the frame; and releasing both stretching and pressing of the mask plate and the frame.

According to a second aspect of the present invention, there is provided a method for fixing to a frame an electrode or a shadow mask for a color image receiving tube, which comprises steps of:

pressing inwardly two confronting sides of an elastic frame by imparting to the frame an amount of forced shift corresponding to a tensile force required for a square mask plate to hold flatness, thereby to bend the frame;

rigidly fixing both supporting ends of the mask plate having apertures formed between the supporting ends at opposite sides to the confronting two sides of the bent frame; and releasing the pressing.

In the present invention both supporting ends of the rectangular mask plate are stretched in two opposite directions to generate the tensile force of a uniform distribution on the surface of the plate, while the pair of the elastic supporting elements are pressed inward in a manner that the distribution of the pressing force in a direction of each of the sides approximately balances with the distribution of the tensile force. Both supporting ends are fixedly secured to the elastic supporting elements. In the construction defined above, the pressing operation is carried out to show a distribution of the force in a curve having a minimum value at a central part of each elastic supporting element. In consequence, since each supporting element applies a spring force of a uniform distribution to the mask plate, a compression force to the mask plate is balanced with a repulsive force acting on the frame when the stretching and pressing operations are both released. In other words, the mask plate is maintained approximately in the same state as before the pressing operation is released, and therefore the mask plate is stably stretched over the frame with high flatness while a uniform tensile force is applied thereto.

In the present invention according to the second aspect, two confronting sides of the frame are pressed inwardly and than rigidly secured to both supporting ends of the mask plate. Since the pressing force at this time has a distribution spreading along two confronting sides of the frame so that the frame is deformed to apply a uniform tensile force to the mask plate when the pressing operation is released, it becomes unnecessary to stretch the mask plate beforehand, unlike the first aspect. In other words, the frame itself substitutes the stretching operation to apply the tension to the mask plate. The balancing action is similar to that in the first aspect and is attained in a relatively small number of steps.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1A:
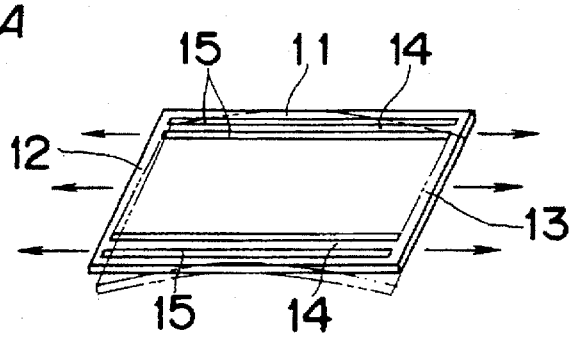
FIGS. 1A, 1B, 1C, and 1D are perspective views of assembling steps of a mask plate and a frame in one embodiment of the present invention.

Before the description of the present invention proceeds, it is to be noted that like parts are designated by like reference numerals throughout the accompanying drawings.

Preferred embodiments of the present invention will be described with reference to the accompanying drawings.

Referring to FIG. 1A, a rectangular mask plate 11 of metal such as iron or nickel-iron alloy has many wire-shaped or strip parts 14 arranged at a predetermined pitch between two supporting ends 12 and 13 at opposite sides of the plate 11. A slot-shaped aperture 15 is formed between the adjacent strip parts 14. The supporting ends 12 and 13 are stretched in opposite directions as indicated by arrows. In other words, for example, 10 Kgf/mm$^2$ tensile force is generated uniformly all over a surface of the mask plate 11.

Figure 1B:
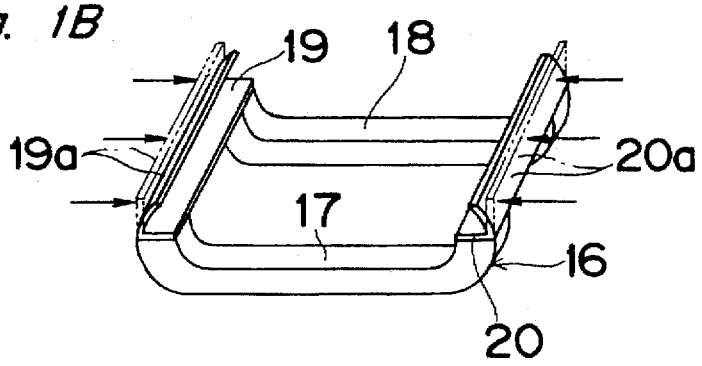

Meanwhile, in FIG. 1B, a rectangular frame 16 of metal such as iron or ferrochromium comprises a pair of U-shaped elements 17 and 18 which are parallel to each other and a pair of elastic supporting elements 19 and 20, each having an L-shaped cross section, linking ends of the elements 17 and 18. Projecting ends 19*a* and 20*a* of the supporting elements 19 and 20 are pressed inward as shown by arrows with, for example, approximately 10 Kgf/mm$^2$ force to apply a uniform load to the frame 16, thereby generating a repulsive force in the frame 16.

Figure 1C:
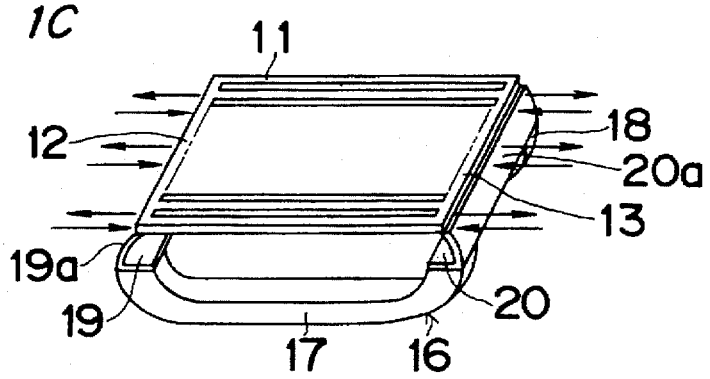

While the mask plate 11 and frame 16 are respectively stretched and pressed in the above-described manner, the mask plate 11 is superposed on the projecting ends 19*a* and 20*a* of the elastic supporting elements 19 and 20 as indicated in FIG. 1C, and the supporting ends 12 and 13 of the mask plate 11 are rigidly secured to the projecting ends 19*a* and 20*a* of the elastic supporting elements 19 and 20. The mask plate 11 is face-bonded where it contacts the projecting ends 19*a* and 20*a* by welding or soldering.

Figure 1D:
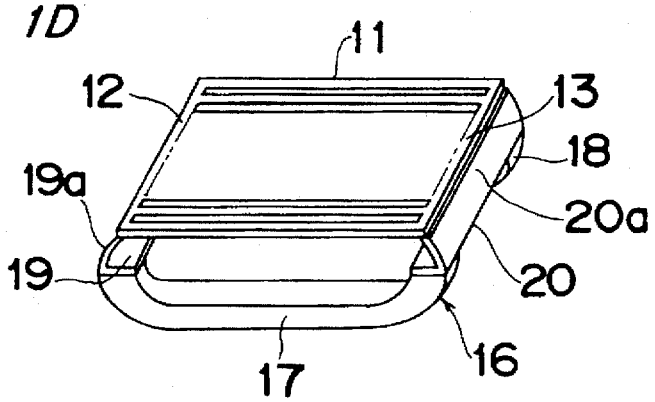

When the mask plate 11 is completely fixed, the mask plate 11 and the frame 16 are released from the respective stretching and pressing. At this time, since a compression force acting on the mask plate 11 balances with the repulsive force in the frame 16, the mask plate 11 is tensed over the frame 16 and is supported thereon in a flat condition as shown in FIG. 1D.

Figure 2:
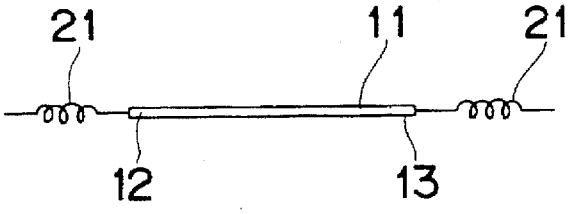
FIG. 2 is a schematic diagram of a stretching step of the mask plate in an embodiment of the present invention.

Tension springs 21 shown in FIG. 2 may be employed to stretch the mask plate 11. The spring 21 has a spring force corresponding to 10 Kgf/mm$^2$.

Figure 3A:
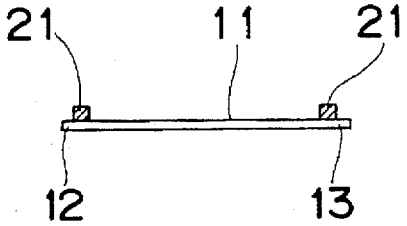
FIGS. 3A and 3B are schematic diagrams of the stretching step of the mask plate in a different embodiment of the present invention.
Figure 3B:
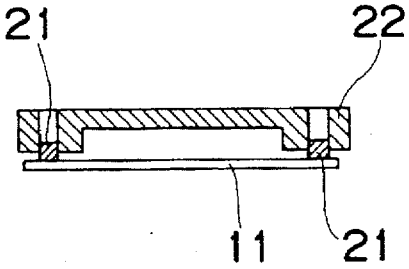

FIG. 3A illustrates another example in which brackets 21 are provided at both supporting ends 12 and 13 of the mask plate 11. The brackets 21 are pressed by a mold 22 in FIG. 3B, similar to press molding, and an amount of force calculated from a predetermined tensile force is applied to the mask plate 11 to put the mask plate 11 in a state of tension.

Figure 4:
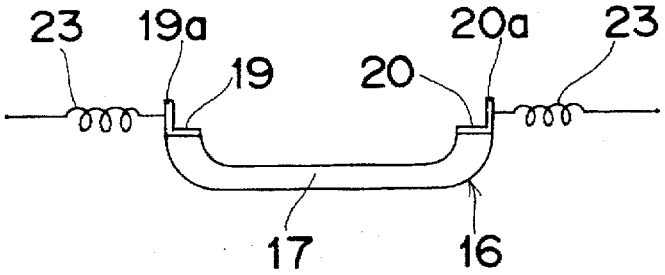
FIG. 4 is a schematic diagram of a pressing step of a frame in an embodiment of the present invention.

Also in the pressing step of the elastic supporting elements 19 and 20 of the frame 16, compression springs 23 may be used as indicated in FIG. 4. In this case, the springs 23 press the projecting ends 19*a* and 20*a* of the supporting elements 19 and 20 inwardly with a spring force of 10 Kgf/mm$^2$.

Figure 5:
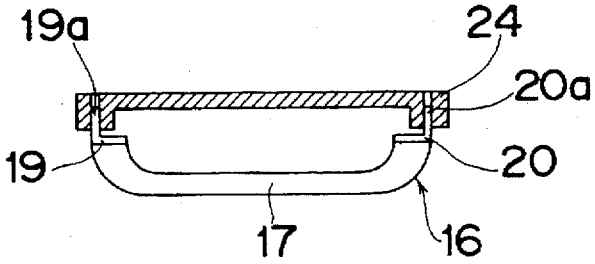
FIG. 5 is a schematic diagram of the pressing step of the frame in another embodiment of the present invention.
Figure 6:
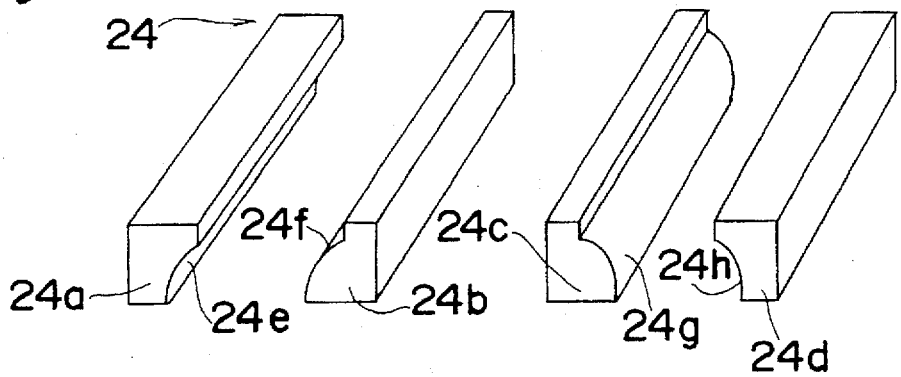
FIGS. 6 and 7 are a perspective view and a cross sectional side view of molds used in the pressing step in FIG. 5.
Figure 7:
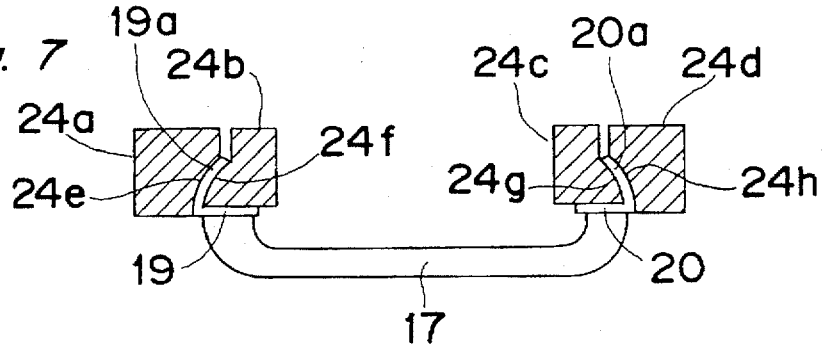

In another embodiment, as shown in FIGS. 5, 6, and 7, the projecting ends 19*a* and 20*a* of the elements 19 and 20 are pressed inwardly by a mold 24 to apply a forced shift to the frame 16. The mold 24 includes two pairs of parts 24*a*, 24*b*, 24*c*, and 24*d*. The outside parts 24*a* and 24*d* have inner surfaces which define curved recesses 24*e* and 24*h* which are brought into contact with the outer surfaces of the projecting ends 19*a* and 20*a*. The inside parts 24*b* and 24*c* have outer surfaces which define curved projections 24*f* and 24*g* which are brought into contact with the inner surfaces of the projecting ends 19*a* and 20*a*. Then, the projecting ends 19*a* and 20*a* are held between the inside and outside parts 24*a* and 24*b* and 24*c* and 24*d* to press the projecting ends 19*a* and 20*a* inwardly.

Figure 8:
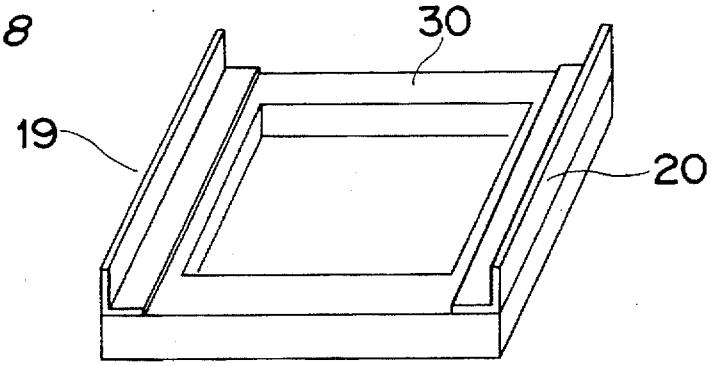
FIG. 8 is a perspective view of a rectangular frame and supporting elements, according to another embodiment of the present invention.

A rectangular frame 30, according to another embodiment of the present invention, is shown in FIG. 8. An area for fixing the supporting elements 19 and 20 to the frame 30 is increased as compared with the embodiment shown in FIGS. 1A–1D to securely fix the supporting elements 19 and 20 to the frame 30.

Figure 9:
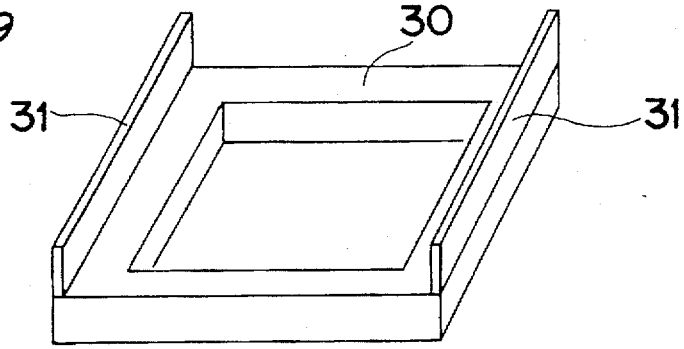
FIG. 9 is a perspective view of supporting elements 31 according to another embodiment of the present invention.

Supporting elements 31, according to another embodiment of the present invention, are shown in FIG. 9 and fixed to the frame 30. Such supporting elements 31 are effective when a tension amount of each supporting element 31 is small, thus making the supporting elements 31 light in weight and simple in construction.

Although the frames in FIGS. 1A–1D, 8, and 9 are used only when tension forces in two directions are applied to the electrodes of wire-shape or strip-shape, frames in FIGS. 10A, 10B, 11A, 11B, 12, 13, and 17 are used when tension forces in four directions are applied to electrodes having holes arranged in a matrix as shown in FIGS. 14A, 14B, 15A, 15B, 16A, and 16B, according to further embodiments of the present invention.

Figure 10A:
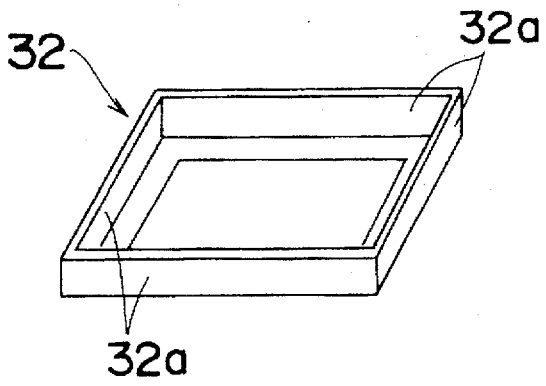
FIGS. 10A and 10B are a perspective view and a cross sectional side view of a frame according to another embodiment of the present invention.
Figure 10B:
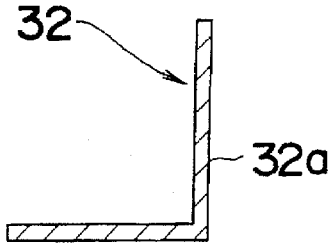

In FIGS. 10A and 10B, the frame 32 is constituted by four elastic supporting elements 32*a* each having an L-shaped cross section and being connected with each other in an integral form.

Figure 11A:
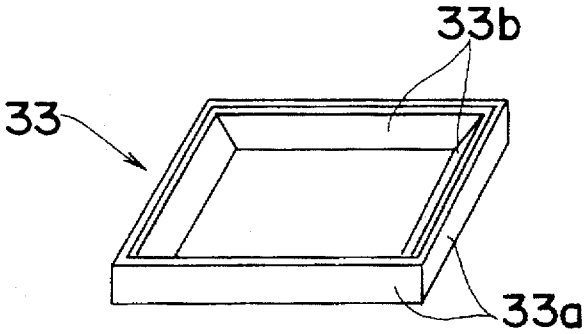
FIGS. 11A and 11B are a perspective view and a cross sectional side view of a frame according to another embodiment of the present invention.
Figure 11B:
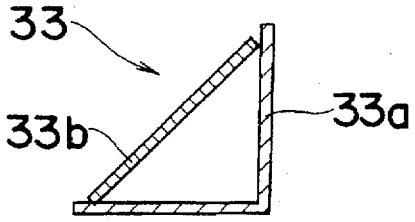

In FIGS. 11A and 11B, the frame 33 is constituted by four elastic supporting elements 33*a* each having an L-shaped cross section and being connected with each other in an integral form similar to the frame 32, and four reinforcing plates 33*b* each fixed to two inner surfaces of each supporting element 33*a* so that the supporting element 33*a* and the plate 33*b* together have a triangular cross section. The frame 33 is effective when it is required to have more rigidity than that in FIGS. 10A and 10B due to increased thickness of the mask plate.

Figure 12:
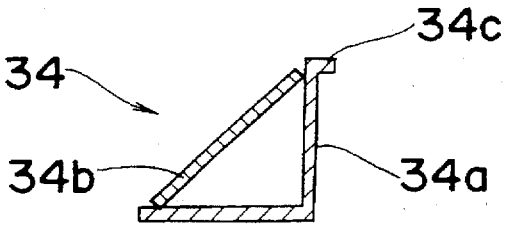
FIGS. 12 and 13 are cross sectional side views of frames according to another embodiment of the present invention.

In FIG. 12, the frame 34 has a similar construction to the frame 33, that is, frame 34 is constituted by four elastic supporting elements 34*a*, each having an L-shaped cross section and being connected with each other in an integral form, and four reinforcing plates 34*b* each fixed to two inner surfaces of each supporting element 34*a* so that the supporting element 34*a* and the plate 34*b* have a triangular cross section. The difference between frames 33 and 34 is that the supporting element 34*a* has a projection 34*c* at its upper edge. According to the frame 34, even when the thickness of the frame 34 is small, the mask plate can be fixed to the frame 34 over a sufficiently large area.

Figure 13:
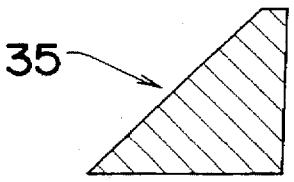

In FIG. 13, the frame 35 has a similar cross section to that of frame 34, but the frame 35 is made of a simple solid member. According to the frame 35, the number of parts can be reduced as compared with that of the frame 34.

Figure 14A:
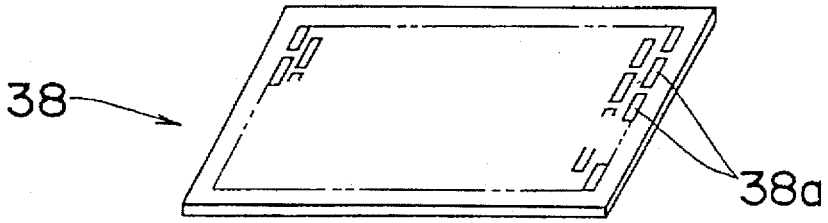
FIGS. 14A and 14B are a perspective view of a mask plate according to another embodiment of the present invention and an enlarged perspective view of a part of the mask plate.
Figure 14B:
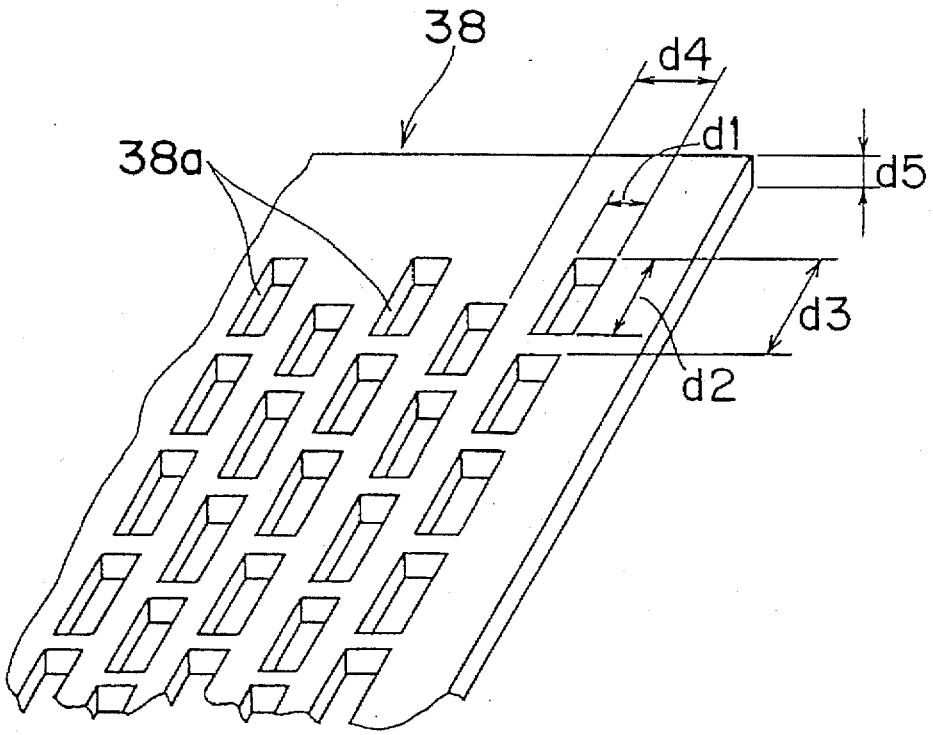

In FIGS. 14A and 14B, the mask plate 38 has many rectangular holes 38*a* arranged in a matrix. As one example, hole 38*a* has a width d1=0.06 mm and a length d2=0.25 mm, a gap between the holes 38*a* in the longitudinal direction of the hole is equal to a distance d3 minus hole length d2, e.g., 0.29–0.25=0.04 mm, a gap between the holes 38*a* in a direction perpendicular to the longitudinal direction of the hole is a distance d4 minus hole width d1, e.g., 0.24–0.06=0.18 mm, and the mask plate 38 is made of iron and has a thickness d5 of 0.025 mm, a width of 300 mm and a length of 400 mm.

Figure 15A:
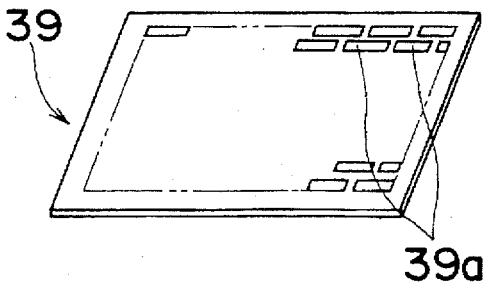
FIGS. 15A and 15B are a perspective view of a mask plate according to another embodiment of the present invention and an enlarged perspective view of a part of the mask plate.
Figure 15B:
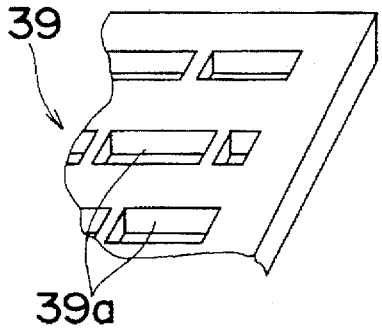

Although the holes 38*a* are arranged so that the longitudinal axis of each hole 38*a* is perpendicular to the longitudinal direction of the mask plate 38 in FIG. 14A, as shown in FIGS. 15A and 15B, the longitudinal axis of a hole 39*a* is perpendicular to the longitudinal direction of the mask plate 39.

Figure 16A:
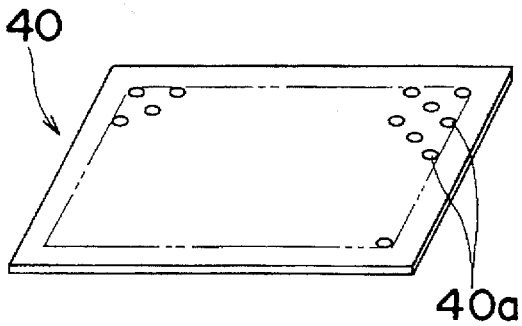
FIGS. 16A and 16B are a perspective view of a mask plate according to another embodiment of the present invention and an enlarged perspective view of a part of the mask plate.
Figure 16B:
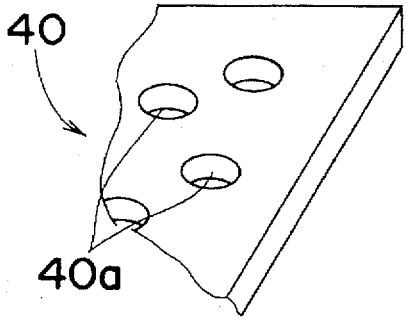

The configuration of the hole can be formed in any shape such as a circle as shown in FIGS. 16A and 16B. The mask plate 40 has circular holes 40*a* arranged in a matrix.

Figure 17:
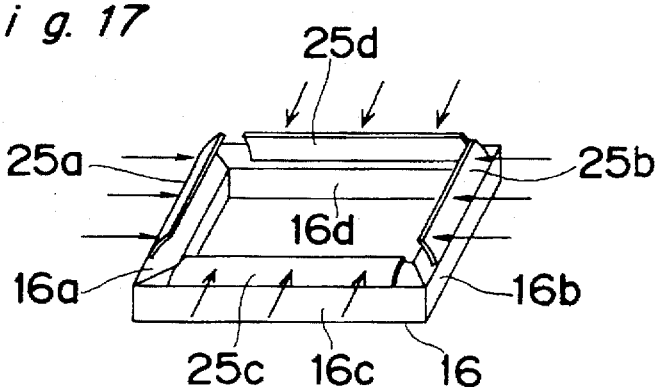
FIG. 17 is a perspective view of the pressing step of the frame in a still different embodiment of the present invention.

In a different embodiment in FIG. 17, not only are elastic projecting ends 25*a* and 25*b* at confronting sides 16*a* and 16*b* pressed inwardly, but elastic projecting ends 25*c* and 25*d* at the other confronting sides 16*c* and 16*d* of the frame are similarly pressed inwardly. The mask plate 11 to which a tensile force is impressed in four directions is laid over the pressed projecting ends 25*a*, 25*b*, 25*c*, and 25*d* to be securely bonded at the four sides. Thereafter, each external force by the stretching and pressing operations is removed. The mask plate 11 is stretched flatly over the frame 16 in the embodiment of FIG. 17.

Although the external force is different depending on the material, thickness, and strength of the frame 16, it is practically 2 Kgf/mm$^2$ to 15 Kgf/mm$^2$, preferably 8 Kgf/mm$^2$ to 12 Kgf/mm$^2$. However, an initial aim is not accomplished without the balance between the tensile force and the pressing force.

Figure 18A:
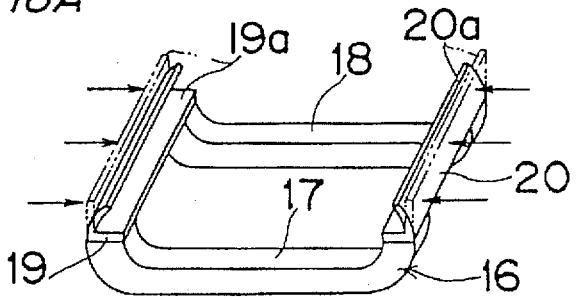
FIGS. 18A, 18B, 18C, and 18D are perspective views of assembling steps of a mask plate and a frame in yet a further embodiment of the present invention.

An amount of forced shift corresponding to the tensile force (for instance, 10 Kgf/mm$^2$) required for the mask plate 11 to hold a predetermined flatness may be preliminarily impressed to the frame 16. For this purpose, as shown in FIG. 18A, each projecting end 19*a*, 20*a* of the elastic supporting element 19, 20 of the frame 16 is pressed with a force equal to the above forced shift in a distribution of a curve showing a minimum value at a center of each supporting element 19, 20. Subsequently, the projecting ends 19*a* and 20*a* of the elements 19 and 20 are further pressed inward with 10 Kgf/mm$^2$, as in FIG. 18B, to produce a strong repulsive force in the frame 16.

Figure 18B:
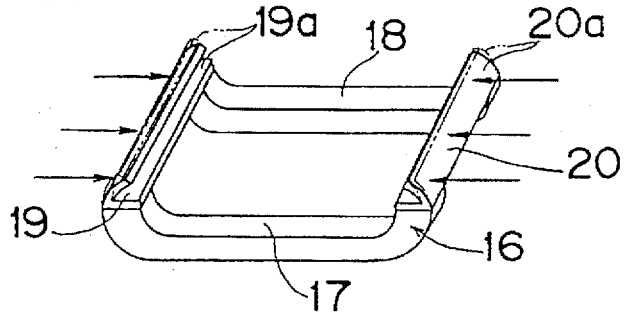
Figure 18C:
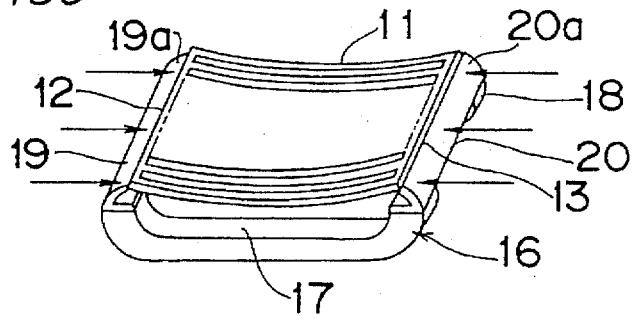
Figure 18D:
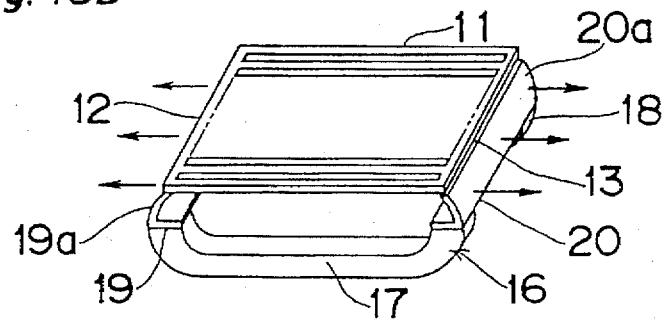

Thereafter, in the above condition, both supporting ends 13 and 14 of the mask plate 11 are strictly welded or soldered to the projecting ends 19*a* and 20*a* of the frame 16, as indicated in FIG. 18C. No tensile force is applied to the mask plate 11 at this stage. Although the warp of the mask plate 11 is greatly exaggerated in FIGS. 18A–18C, the mask plate 11 actually warps a little. After the frame 16 is released from the pressing operation, the mask plate 11 is tensioned between the elastic supporting elements 19 and 20 of the frame 16 with a high degree of flatness as is clearly shown in FIG. 18D.

The pressing in FIG. 18A may be carried out simultaneously with that in FIG. 18B. In any case, the stretching of the mask plate 11 is achieved by the pressed frame 16. That is, the same operation and effect as in the embodiment in FIGS. 1A–1D are realized without stretching the mask plate 11 beforehand, and therefore the number of tools and steps is reduced.

Figure 19A:
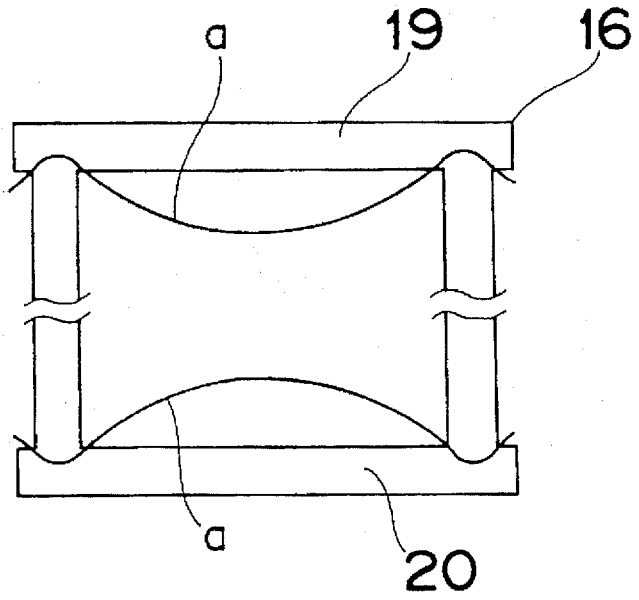
FIGS. 19A and 19B are diagrams of a relation between an amount of a forced shift of the frame and a repulsive force remaining in the frame.
Figure 19B:
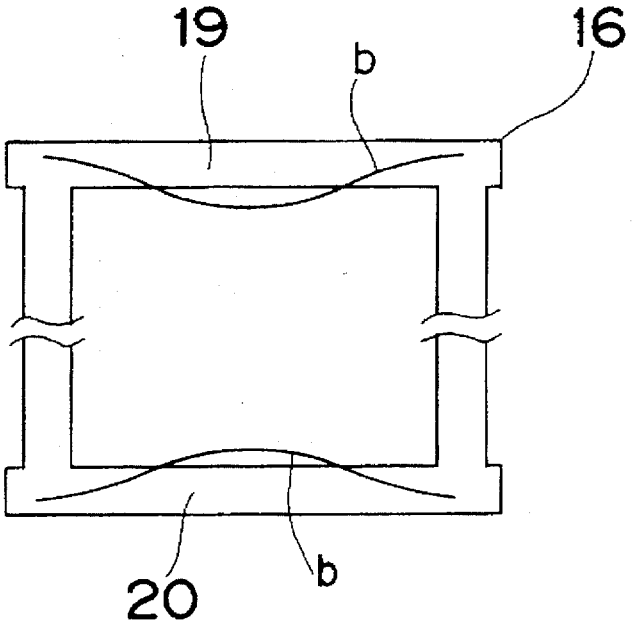
Figure 20:
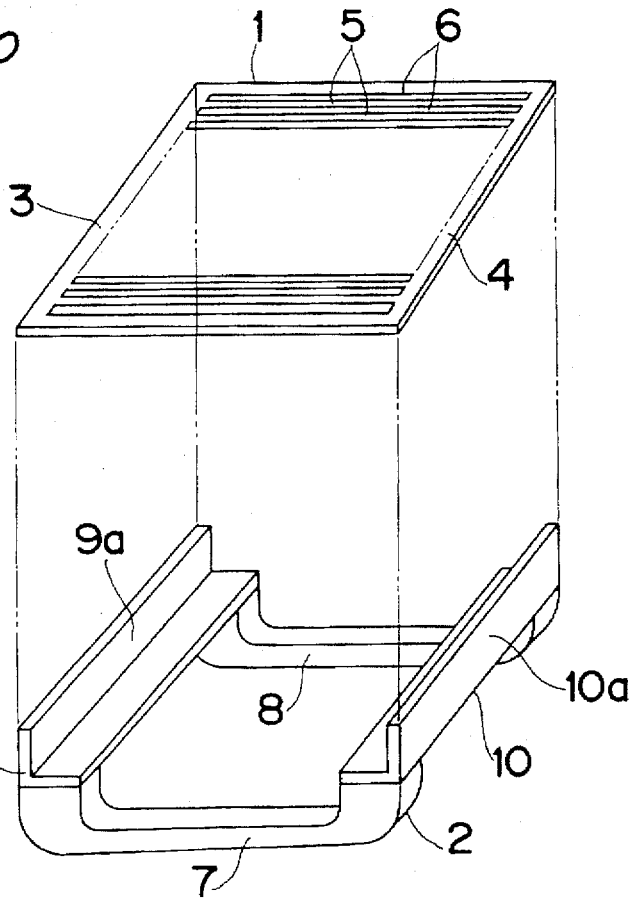
Fig. 20 PRIOR ART
FIG. 20 is an exploded perspective view of a conventional color-selecting electrode of a mask type.
Figure 21A:
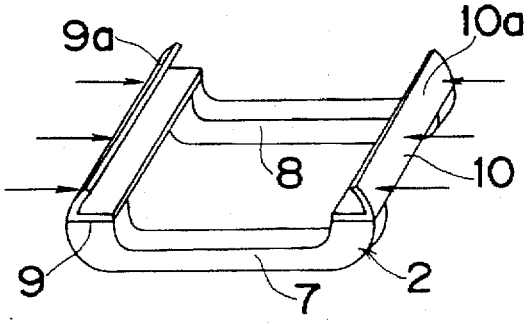
Fig. 21A PRIOR ART
FIGS. 21A, 21B, and 21C are perspective views of assembling steps of the conventional mask-type color-selecting electrode.
Figure 21B:
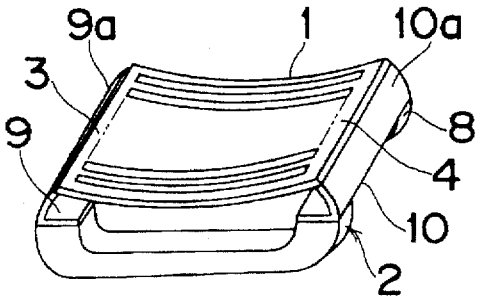
Fig. 21B PRIOR ART
Figure 21C:
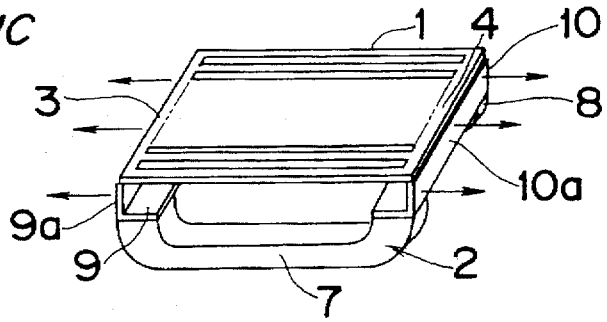
Fig. 21C PRIOR ART

The frame in FIG. 19A has elastic supporting elements 19 and 20 separated 360 mm at confronting sides thereof. The forced shift to each of the elastic supporting elements 19 and 20 represents a curve (a) having a minimum value at a middle of the element 19, 20. The repulsive force showing a distribution of a curve (b) of FIG. 19B remains in each supporting element 19, 20 when the external force is removed therefrom after the supporting element is fixed to the supporting end of the mask plate.

Although the above embodiments are applied to the color-selecting electrodes, such embodiments can be applied to shadow masks.

According to the present invention as above, the mask plate is stably brought to a stretched condition between two confronting sides of the frame while maintaining a high degree of flatness, and therefore a color image receiving tube of superior color reproducibility is obtained.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A method of attaching a shadow mask for an image receiving tube to a frame, the method comprising:

applying a tensile force of 8 Kgf/mm$^2$ to 12 Kgf/mm$^2$ to stretch a rectangular mask plate having apertures located between opposite sides of said rectangular mask plate, said tensile force being generated by pulling opposite sides of said rectangular mask plate in opposite directions such that said tensile force has a uniform distribution over the surface of said rectangular mask plate;

applying a pressing force of 8 Kgf/mm$^2$ to 12 Kgf/mm$^2$ to a pair of elastic supporting elements which are provided on two confronting sides of a frame so as to bend inwardly said pair of elastic supporting elements, wherein a distribution of said pressing force acting on said elastic supporting elements approximately balances with the distribution of said tensile force applied to said rectangular mask plate;

rigidly fixing said opposite sides of said mask plate, subject to said tensile force, to said pair of elastic supporting elements of said frame; and releasing both said tensile force, applied to said mask plate, and said pressing force applied to said elastic supporting elements provided on said frame.

2. The method as claimed in claim 1, wherein each of said confronting sides of said frame extends in both a horizontal direction and a vertical direction.

3. A method of fixing a shadow mask for a color image receiving tube to a frame, the method comprising:

applying a pressing force of 8 Kgf/mm$^2$ to 12 Kgf/mm$^2$ to two confronting sides of an elastic frame in order to bend said frame;

applying a tensile force of 8 Kgf/mm$^2$ to 12 Kgf/mm$^2$ to a rectangular mask plate so as to hold said rectangular mask plate in a flat condition;

rigidly fixing opposite supporting ends of said mask plate to said confronting sides of said bent elastic frame; and releasing said pressing force.

4. The method as claimed in claim 3, wherein said pressing force, applied to said two confronting sides of said elastic frame, is equal to a forced shift represented by a curve distributed such that there is a minimum value applied at a center of each of said confronting sides.

5. The method as claimed in claim 3, wherein each of said confronting two sides of said elastic frame extends in both a horizontal direction and a vertical direction.

6. A method of fixing a metallic plate to a frame, said method comprising:

applying a tensile force of 8 Kgf/mm$^2$ to 12 Kgf/mm$^2$ to opposite sides of a rectangular metallic plate which has apertures formed between opposite supporting ends of said rectangular metallic plate, wherein said tensile force applied to said rectangular metallic plate is uniformly distributed over a surface of said rectangular metallic plate;

applying an inwardly directed pressing force of 8 Kgf/mm$^2$ to 12 Kgf/mm$^2$ to a pair of elastic supporting elements defining two confronting sides of a frame such that said pressing force approximately balances said tensile force;

rigidly fixing each of said opposite support ends of said rectangular metallic plate to said pair of elastic supporting elements which are being pressed, respectively; and releasing both of said tensile force and said pressing force applied to said rectangular metallic plate and said pair of elastic supporting elements, respectively.

7. A method of fixing a metallic plate to a frame, the method comprising:

applying an inwardly directed pressing force of 8 Kgf/mm$^2$ to 12 Kgf/mm$^2$ to two confronting sides of an elastic frame so as to bend said elastic frame;

applying a tensile force to a rectangular metallic plate to hold said plate in a flat condition, wherein said tensile force corresponds to the amount of said pressing force applied to said elastic frame;

rigidly fixing opposite supporting ends of said rectangular metallic plate to said two confronting sides of said elastic frame while being pressed by said inwardly directed pressing force; and releasing said pressing force.

* * * * *